United States Patent [19]

Sams

[11] Patent Number: 5,014,886

[45] Date of Patent: May 14, 1991

[54] DISPENSING VALVE

[75] Inventor: Bernard Sams, London, England

[73] Assignee: Reed Packaging Limited, Kent, England

[21] Appl. No.: 353,894

[22] Filed: May 17, 1989

[30] Foreign Application Priority Data

May 18, 1988 [GB] United Kingdom ..... 8811758

[51] Int. Cl.[5] ..... B65D 83/00

[52] U.S. Cl. ..... 222/399; 222/400.7; 222/509

[58] Field of Search ..... 222/399, 396, 400.7, 222/509, 61

[56] References Cited

U.S. PATENT DOCUMENTS

| | | | |
|---|---|---|---|
| 2,720,342 | 10/1955 | Fleck . | |
| 3,119,544 | 3/1962 | Cope et al. . | |
| 3,246,825 | 6/1964 | Zastrow . | |
| 3,272,404 | 9/1966 | Graves et al. . | |
| 3,349,965 | 10/1967 | Krugger . | |
| 3,373,907 | 3/1968 | Batrow | 222/399 |
| 3,499,582 | 12/1968 | Berney . | |
| 3,612,354 | 10/1971 | Sitton et al. | 222/399 |
| 4,785,977 | 11/1988 | Ball . | |
| 4,804,116 | 2/1989 | Ball | 222/399 |

FOREIGN PATENT DOCUMENTS

| | | | |
|---|---|---|---|
| 410953 | 10/1935 | Belgium . | |
| 186709 | 7/1986 | European Pat. Off. . | |
| 217615 | 4/1987 | European Pat. Off. . | |
| 98965 | 8/1898 | Fed. Rep. of Germany . | |
| 564717 | 1/1924 | France | 222/399 |
| 2297173 | 8/1976 | France . | |
| 88/01981 | 3/1988 | PCT Int'l Appl. . | |
| 89/00544 | 1/1989 | PCT Int'l Appl. . | |
| 423618 | 5/1967 | Switzerland . | |
| 16087 | 7/1897 | United Kingdom | 222/399 |
| 26340 | 11/1897 | United Kingdom | 222/399 |
| 922347 | 3/1963 | United Kingdom . | |
| 938528 | 10/1963 | United Kingdom . | |
| 1013287 | 12/1965 | United Kingdom . | |
| 1135971 | 12/1968 | United Kingdom . | |
| 1177288 | 1/1970 | United Kingdom . | |
| 1236645 | 6/1971 | United Kingdom . | |
| 1293195 | 10/1972 | United Kingdom . | |
| 1504986 | 3/1978 | United Kingdom . | |
| 2180890 | 4/1987 | United Kingdom | 222/396 |
| 2185537 | 7/1987 | United Kingdom . | |
| 2194938 | 3/1988 | United Kingdom . | |
| 2217787 | 11/1989 | United Kingdom . | |

*Primary Examiner*—H. Grant Skaggs
*Attorney, Agent, or Firm*—Lyon & Lyon

[57] ABSTRACT

A dispensing valve unit for a gasified beverage, which unit (1) is adapted to be operatively connected both to a container (2) of gasified beverage and to a container (3) of gas for topping up the said beverage container with gas, and is so arranged as, when operated, both to dispense the beverage by gravity flow and to cause topping up gas from the gas container, regulated to substantially the same pressure as exists in the beverage container, to be supplied to the beverage container to replace the beverage dispensed therefrom.

16 Claims, 5 Drawing Sheets

FIG. 3.
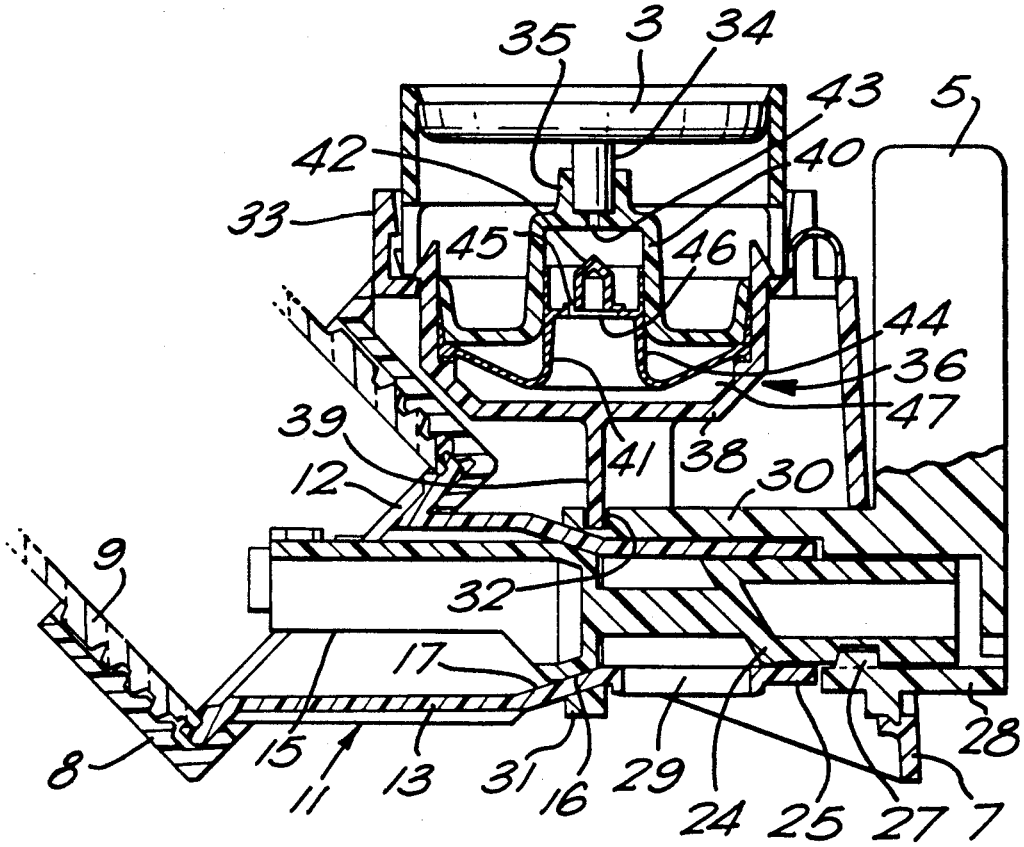
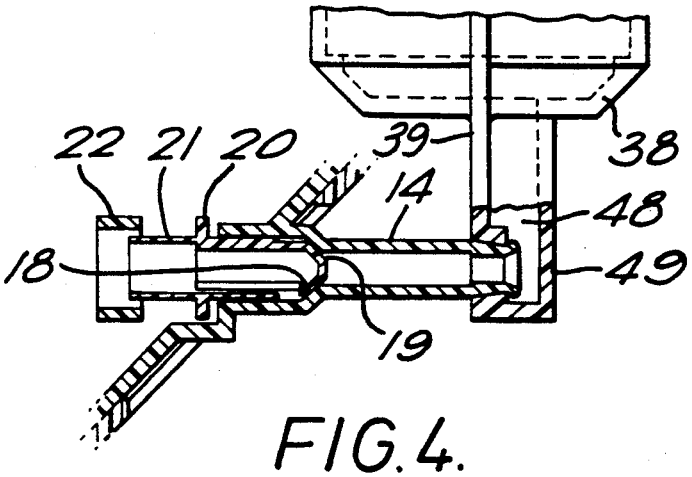
FIG. 4.

DISPENSING VALVE

This invention relates to dispensing valves for gasified beverages which are supplied to the user in a suitable container and in a ready to drink, gasified, condition. Examples of such beverages are lemonade, beer, and other more or less "fizzy" drinks, which are usually gasified by means of carbon dioxide ($CO_2$), or a mixture of gases.

Often such beverages are supplied to the user in relatively small containers, such as cans or bottles of a size of the order of a half-pint, all of whose contents will be used at a single time, and the beverage is then enjoyed in its pristine condition, straight from the previously sealed container. However, if the beverage is supplied to the user in a larger container, for example of one or two litres capacity, the whole contents of the container will often not be used at a single time, and the problem then arises that the degree of gasification, and thus the quality, of the beverage which is left in the container is reduced, due to loss of gas into the empty space left in the container. Indeed, the remaining beverage may eventually go more or less "flat" after repeated opening and closing of the container.

It has been proposed, as disclosed for example in GB-A-2180890, to provide such a beverage container, in a suitable housing, in combination with a container of $CO_2$, together with valving arrangements operable by the user to top up the beverage container with $CO_2$ whenever some of the beverage is dispensed. However, in this previous proposal it has been necessary for the user separately to operate valves for initially releasing $CO_2$ from the $CO_2$ container and subsequently dispensing the beverage and topping up the beverage container with $CO_2$, which is an undesirably complicated procedure for the non-technical, e.g. domestic, end user.

According to the present invention there is provided a dispensing valve unit for a gasified beverage, which unit is adapted to be operatively connected both to a container of gasified beverage and to a container of gas for topping up the said beverage container with gas, and is so arranged as, when operated, both to dispense the beverage by gravity flow and to cause topping up gas from the gas container, regulated to substantially the same pressure as exists in the beverage container, to be supplied to the beverage container to replace the beverage dispensed therefrom.

Preferably the said dispensing valve unit is adapted to be mounted directly to the outlets of the beverage container and the gas container respectively, to avoid the use of any pipe-work therebetween which might be prone to leakage problems in use.

Preferably the dispensing valve unit has an operating member which is arranged, upon a single movement thereof, both to dispense the beverage and to cause topping up gas to be supplied to the beverage container as aforesaid. Preferably the arrangement is such that a first part of the said movement of the operating member opens a closure valve of the gas container to charge a chamber in the valve unit with pressurised gas to the same pressure as exists in the beverage container, while a further part of the movement of the operating member both opens a dispensing flow path for the beverage out of the beverage container and through the valve unit to the exterior and opens a flow path for the pressurised gas out of the said chamber and into the beverage container. Preferably the said movement of the operating member is a rotary movement, e.g. of an operating handle. Preferably the arrangement is such that rotary movement of the operating member in either direction from a rest (closed) position effects the above operations.

Preferably the said dispensing valve unit is adapted to have a said gas container, in the form of an aerosol can for example, mounted and supported thereon in an inverted condition, with its outlet pointing downwards into the valve unit. The valve unit may then incorporate an opening mechanism for the outlet valve of the gas container, which is arranged to be displaced upwardly, to open the gas container outlet valve, by the said first part of the movement of the said operating member of the valve unit. Preferably such mechanism incorporates a pressure equalising device for shutting the gas container outlet valve when the gas pressure in the said chamber is equal to that in the beverage container.

Preferably the said dispensing valve unit is adapted to be mounted to the outlet of a beverage container with the said container in an at least partially inverted condition, so that beverage can flow out of the container by gravity, assisted by the gas pressure above the beverage. As a result, a beverage container for use with a said valve unit may be of a very simple and inexpensive type, without a dip tube or any other failure-prone means for extracting the beverage from the container. For example a container of the well known PET (polyethylene teraphthalate) type may be used. When intended for use with such a container, i.e. one which does not incorporate its own outlet valve, the said dispensing valve unit will incorporate a beverage outlet valve, which in the preferred form of valve unit already mentioned will be arranged to be opened by the said further part of the movement of the said operating member. In the preferred form of valve unit in which the said movement of the operating member is a rotary movement, the said operating member is preferably provided with a camming member which acts on the said beverage outlet valve to open the same. Preferably the said beverage outlet valve is associated with a further valve, arranged to be opened and closed substantially in concert therewith, for admitting topping up gas to the beverage container by way of the said valve unit at the same time as beverage is released from the said container.

An embodiment of the invention will now be described by way of example and with reference to the accompanying drawings, in which:

FIG. 3 is a vertical cross-sectional view of the assembled unit, taken axially through the beverage dispensing valve and the topping up gas chamber;

FIG. 4 is a partial vertical cross-sectional view taken axially through the topping up gas inlet valve;

Figure 1:
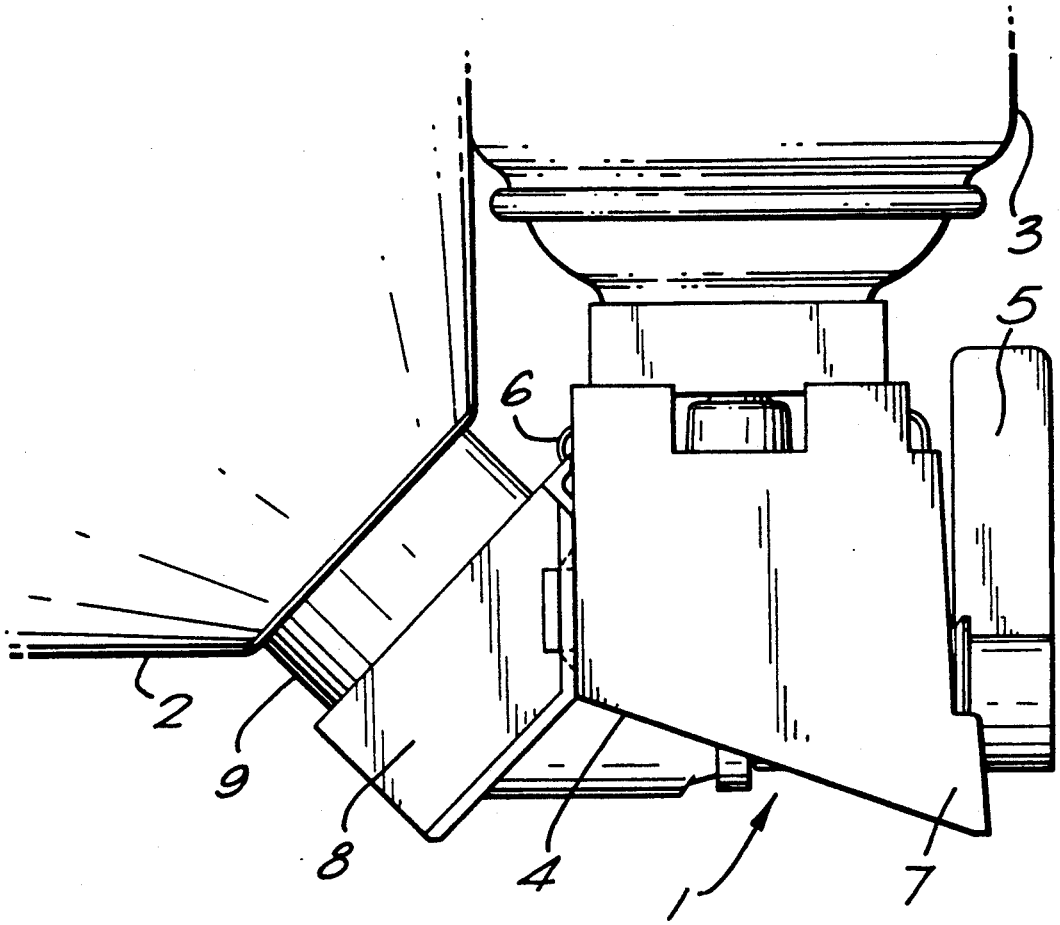
FIG. 1 is a side view of a dispensing valve unit according to the invention, shown in its intended operative association with a beverage container and a gas container, which containers are only partly shown.

Referring first to FIG. 1, a dispensing valve unit 1 according to the invention is shown mounted directly to the respective outlets of a beverage container 2 in the form of a PET bottle, and a gas container 3 in the form of an aerosol can of $CO_2$ (or $CO_2$ mixed with other gases). All of the parts of the valve unit 1 are plastics mouldings, unless otherwise specified. It will be seen that the beverage container 2 is arranged in a vertically inclined position, to permit gravity feed of beverage into the dispensing valve unit, while the gas container 3 is inverted and vertical. Details of the manner in which the two containers and the valve unit may be located and supported in a suitable housing, preferably a cardboard box of the "carry-home" type, are disclosed in our patent application No. 354,410 of even date herewith. For purposes of the present description it is sufficient to say that the beverage container 2 is seated on a suitable supporting surface in such a housing, the valve unit 1 is mounted to the beverage container and is supported by the latter and by the floor of the housing, and the gas container 3 is mounted to and supported on the valve unit.

Figure 7:
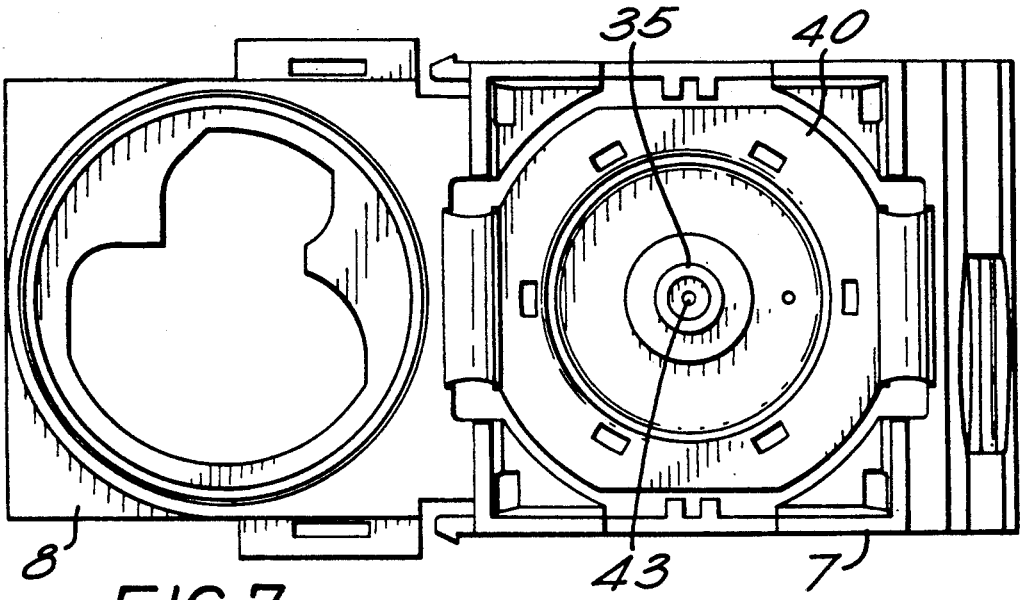
FIG. 7 is an underneath plan view of a housing of the valve unit.
Figure 8:
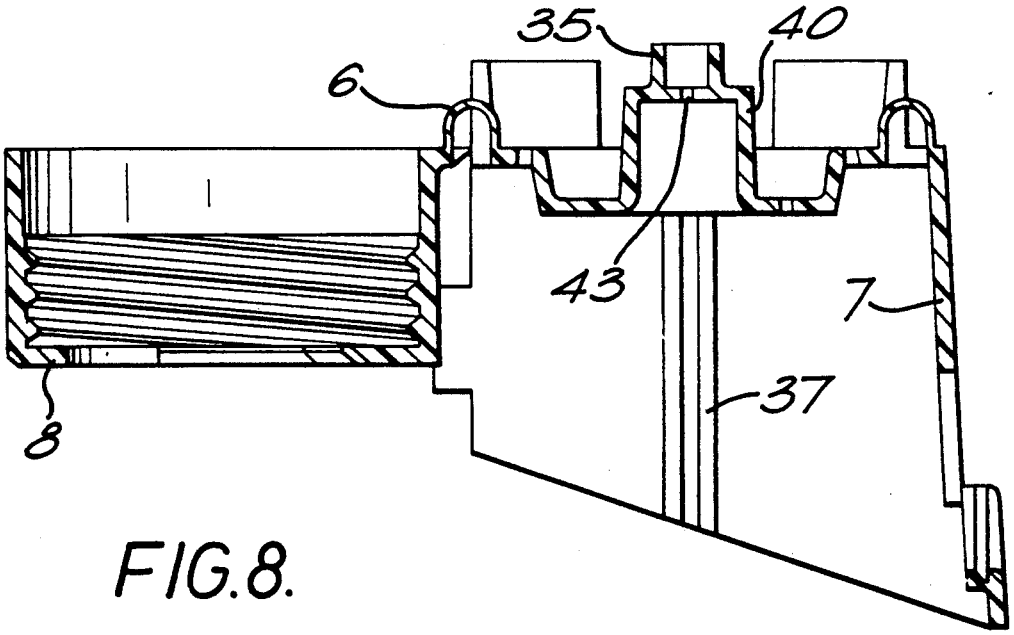
FIG. 8 is a vertical cross-sectional view of the said housing.

The valve unit includes a housing 4 (see particularly FIGS. 7 and 8 and the later description) which encloses a valve mechanism provided with an operating member in the form of a rotary handle 5. The housing 4 has two parts which are integrally hingedly interconnected by a web 6 (see also FIG. 8), viz. a main housing part 7 which encloses most of the valve mechanism, and a tubular part 8 which makes screw-threaded connection with the externally threaded open neck 9 of the beverage container 2.

Figure 2:
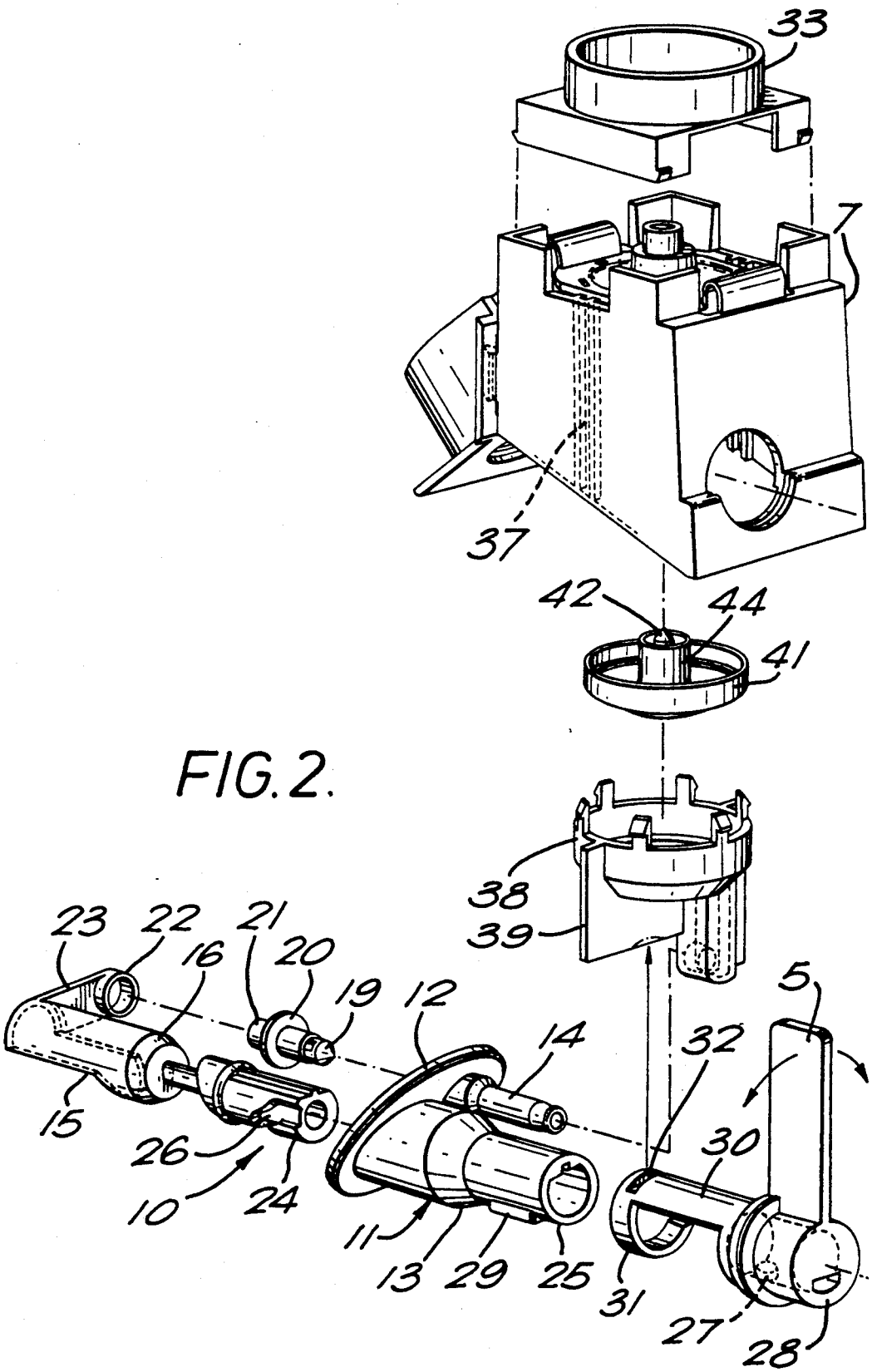
FIG. 2 is an exploded perspective view of the valve unit.
Figure 5:
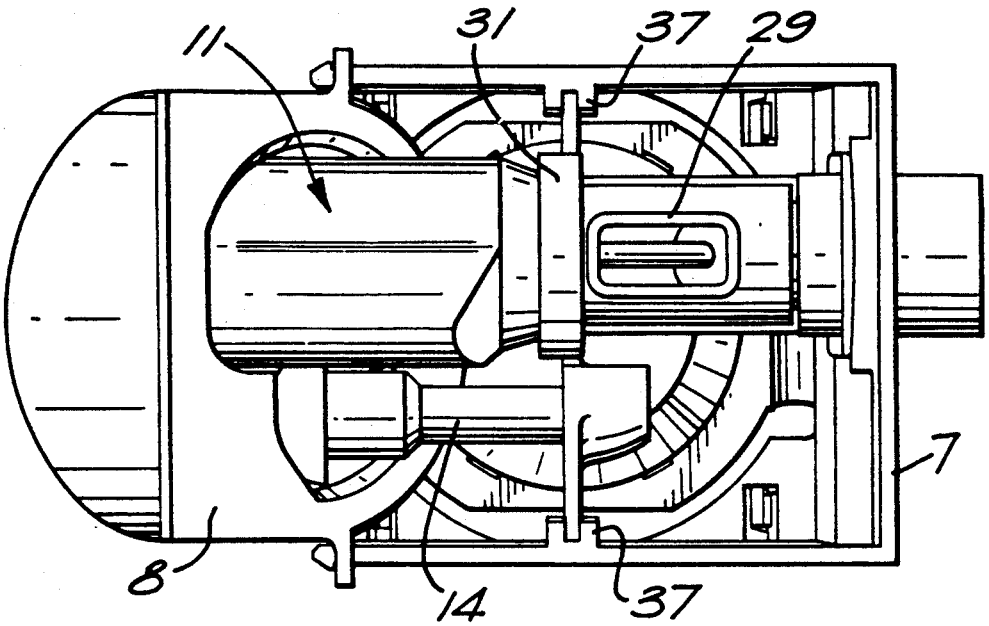
FIG. 5 is an underneath plan view of the assembled valve unit.
Figure 6:
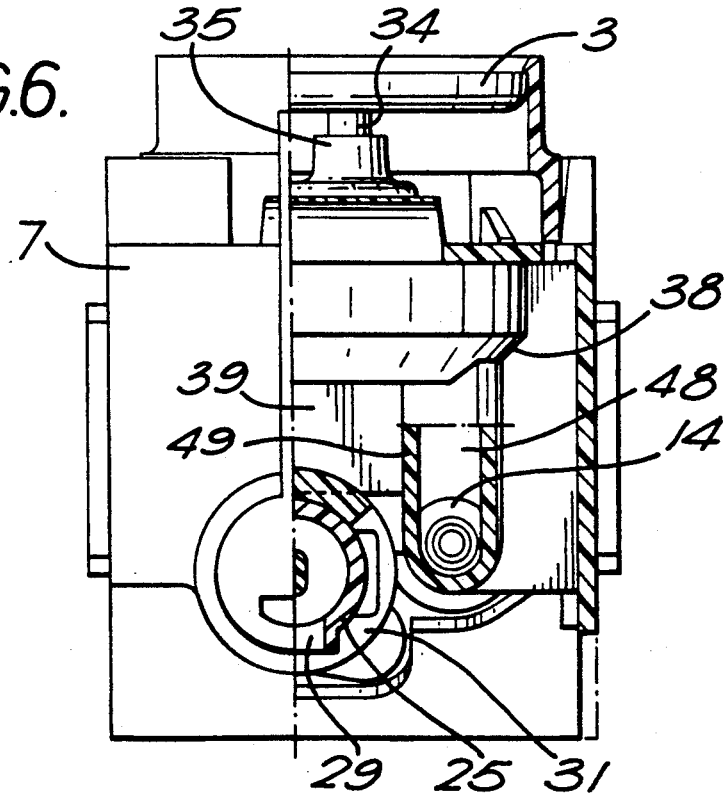
FIG. 6 is a front elevation of the unit, partially in vertical cross-section.

Referring now to FIGS. 2 to 4, the valve mechanism of the dispensing valve unit comprises, firstly, a combined beverage outlet valve and gas inlet valve assembly which is generally indicated at 10 in FIG. 2. This assembly includes a valve housing member 11 provided with a circular baseplate 12 which is received and gripped in gas-tight fashion between the tubular part 8 of the main housing 4 and the neck 9 of the beverage container 2. The housing member 11 defines two tubular valve housings 13 and 14 of the beverage outlet valve and gas inlet valve respectively. A movable valve member 15 of the beverage outlet valve is received in the valve housing 13 and is formed with an annular sealing surface 16 which closes the valve by engagement with an annular valve seat 17 defined inside the housing 13. Similarly the tubular housing 14 of the gas inlet valve defines an internal annular valve seat 18 (FIG. 4) engageable with a conical sealing surface 19 on a movable valve member 20 of the gas inlet valve. A rearward extension 21 of the valve member 20 is loosely received in a sleeve 22 provided on an arm 23 extending laterally from the valve member 15 of the beverage outlet valve.

An actuating member 24 for the beverage outlet valve extends forwardly from the valve member 15, with which it is integral, and is slidably received in a forward tubular extension 25 of the housing 13. A cam track in the form of a helical slot 26 formed in the actuating member 24 receives a pin 27 which extends radially inwardly from the inside wall of tubular sleeve 28 which mounts the operating handle 5. The helical slot 26 is of generally V-shaped configuration, i.e. double-ended, so that rotation of the handle 5 in either direction from its closed position of FIG. 3 causes the actuating member 24, and thus the valve member 15, to be pushed back against the pressure in the beverage container, to open the beverage outlet valve. Such movement of the valve member 15 also releases the gas inlet valve member 20 for similar rearward movement to admit gas into the container 2, as explained below. The forward extension 25 of the housing 13 is formed with a beverage delivery aperture 29 (FIG. 3) in its underside.

The sleeve 28 which mounts the handle 5 has a rearward extension 30 by means of which it is rotatably mounted on the forward extension 25 of the housing 13, and a terminal ring portion 31 of the extension 30 is formed with a slot 32 which provides a cam for operating a gas release valve mechanism now to be described.

Still referring to FIGS. 2 and 3, the bottom end of the inverted gas container 3 is received in a support member 33 which clips into the open top of the main housing. The closure valve operating pin 34 of the gas container is received in a tubular socket 35 of a gas container valve operator generally indicated at 36, mounted for vertical movement in key-ways 37 in the side walls of the housing 7 to open and close the gas container valve. The operator 36 comprises a bottom member 38 formed with a transverse rail 39 which engages in the slot 32 in the extension 30 of the handle-mounting sleeve 28, a top member 40 formed with the socket 35 and, clamped between the bottom and top members 38 and 40, a pressure equalising diaphragm member 41 formed with a closure element 42 engageble in a gas delivery hole 43 in the bottom of the socket 35. A tubular portion 44 of the diaphragm member 41, carrying the closure element 42, is slidable inside a central tubular portion of the top member 40. Apertures 45 for gas flow are formed in a web portion 46 of the diaphragm member 41. A gas storage chamber 47 is defined between the diaphragm member 41 and the bottom member 38, and communicates with the housing 14 of the gas inlet valve via a passage 48 formed in a downward extension 49 of the bottom member 38, with the lower end of which passage the forward, open, end of the housing 14 makes a gas-tight fit.

In operation, the first part of the operating movement of the handle 5, in either direction from its illustrated closed position, raises the gas container valve operator 36, by way of the cam slot 32 and the rail 39, to open the gas container closure valve 34. $CO_2$ gas then flows into the chamber 47, by way of the passages 43 and 45, until the pressure in the chamber is equal to the pressure in the beverage container 2, whereupon the passage 43 is closed by the pressure equalising valve. At this time the gas cannot flow further i.e. beyond the chamber 47, because the gas inlet valve to the beverage container is closed at 18,19.

Further movement of the handle 5 causes the beverage outlet valve member 15 to be pushed back by the action of the pin 27 in the helical slot 26, to open a beverage flow path past the valve member 15 and through the housing 11 to the delivery aperture 29. At the same time, rearward movement of the arm 23 on the member 15 releases the gas inlet valve member 00 for rearward movement, and the reduction in pressure in the beverage container, brought about by the removal of some of the beverage, causes the gas inlet valve member 20 to be pushed back by the gas pressure in the storage chamber 47. Topping up gas then flows into the beverage container until the original pressure in that container is restored, whereupon the passage 43 is again closed by the pressure equalising valve.

When the desired amount of the beverage has been delivered through the aperture 29, the handle 5 is returned to its closed position. A first part of this closing movement causes the beverage outlet valve member 15 to be pulled forward to its closed position by the pin 27, assisted by the liquid and gas pressure in the beverage container. At the same time the gas inlet valve member 20 is pushed towards its closed position by the arm 23, but is completely closed only after the beverage valve is closed, thus ensuring the maintenance of the desired gas pressure in the beverage container. Further movement of the handle to its closed position finally permits closure of the gas container closure valve 34, by downward movement of the operator 36.

I claim:

1. A dispensing valve unit for use in an organization for dispensing gasified beverage including a first container containing said beverage, a second container containing topping up gas for said first container, and an outlet valve controlling gas flow from said second container, said dispensing valve unit comprising:

a selectively movable valve unit operating member;

gas conducting means for placing said second container in flow circulating relation with said first container;

first means operated upon movement of said valve unit operating member to open said outlet valve for the release of topping up gas from said second container into said gas conducting means;

second means operated upon movement of said valve unit operating member to open said first container to dispense beverage therefrom and to release topping up gas from said gas conducting means into said first container; and gas flow regulating means operative in response to pressure in said first container to control gas flow through said outlet valve, whereby the pressure of the topping up gas admitted to said first container corresponds to pressure within said first container.

2. A dispensing valve unit according to claim 1 in which said first means is operated when said operating member is moved through a first part of its movement and said second means is operated when said operating member is moved through a second part of its movement.

3. A dispensing valve unit according to claim 1 in which said second means operated upon movement of said valve unit operating member includes means for releasing topping up gas to said first container substantially simultaneously with dispensing beverage therefrom.

4. A dispensing valve unit according to claim 3 including means for mounting said first container for gravity flow of beverage therefrom.

5. A dispensing valve unit according to claim 1 including means for operatively connecting the outlets of said first and second containers.

6. A dispensing valve unit according to claim 1 in which said valve unit operating member is mounted for rotational movement and is effective to operate the respective means operated thereby upon movement in either direction from a rest position.

7. A dispensing valve unit according to claim 1 in which said gas conducting means includes means forming a gas storage chamber for receipt of topping up gas from said second container and a gas passage interconnecting said chamber with said first container, and a release valve operative in said gas passage to release topping up gas from said chamber to said first container upon opening of said first container by said valve unit operating member for dispensing beverage therefrom.

8. A dispensing valve unit according to any one of claims 1 to 4 including:

a gas actuator mounted for movement with respect to said outlet valve and including top and bottom chamber-forming members for receiving topping up gas received from said first container;

means forming a cam on said valve unit operating member and a follower on said gas actuator effective to move said gas actuator to open said outlet valve and release topping up gas into the chamber formed by said gas actuator top and bottom members upon movement of said valve unit operating member.

9. A dispensing valve unit according to claim 8 including a flexible diaphragm forming said gas flow regulating means positioned in the chamber formed by said gas actuator top and bottom members, said diaphragm communicating on one side with said first container upon opening thereof and having means on the other side thereof to terminate the flow of topping up gas from said second container upon pressure-induced movement of said diaphragm.

10. A dispensing valve unit according to claim 8 in which said outlet valve includes a valve operating pin received by said chamber-forming top member, an opening in said top member aligned with said valve operating pin, and said means on said diaphragm for terminating topping up gas flow being a closure element capable of blocking reception in said top member opening upon pressure-induced movement of said diaphragm.

11. A dispensing valve unit according to any one of claims 1 to 4 including:

an actuating member movable between an open and a closed position for controlling flow of beverage from said first container; and a cam on said valve unit operating member and a follower on said actuating member operative to move said actuating member from its closed to its open position upon movement of said valve unit operating member.

12. A dispensing valve unit according to claim 11 in which said actuating member includes means for opening said gas conducting means for the substantially simultaneous release of topping up gas therefrom upon movement of said actuating member to its open position.

13. A dispensing valve unit according to claim 12 including a movable valve member operative in said gas conducting means between a first, blocking position and a second, release position therein and an arm on said actuating member operatively connected to said valve member to move it between said blocking position and said release position substantially coincident with movement of said actuating member between its open and its closed positions.

14. A dispensing valve unit for use in an organization for dispensing gasified beverage including a beverage container, a topping up gas container and an outlet valve having an operating pin controlling gas flow from said gas container, said dispensing valve unit comprising:

a manually operated valve unit operating member mounted for selective rotational movement to a plurality of positions;

a gas actuator operably positioned with respect to said outlet valve and including top and bottom members cooperating to form a chamber in gas communication with said gas container, said top member including a receptacle having a flow opening for reception of said valve operating pin;

a first cam on said valve unit operating member and a follower on said gas actuator cooperable with said first cam to move said valve operating pin to open said outlet valve and release topping up gas through said flow opening into said chamber upon movement of said valve unit operating member through a first part of movement;

a flexible diaphragm disposed in said chamber and communicating on one side with said beverage container when open and having a closure element on the other side thereof effective to close said flow opening upon pressure-induced movement of said diaphragm;

an actuating member movable between an open and a closed position for controlling flow of beverage from said beverage container;

a second cam on said valve unit operating member and a follower on said actuating member cooperatively arranged to move said actuating member from a closed to an open position upon movement of said valve unit operating member through a second part of movement;

means forming a gas passage communicating at one end with said chamber and at the other end with said beverage container when said actuating member is in its open position;

a valve member disposed in said gas passage and movable from a blocking to a release position therein; and an arm on said actuating member operatively connecting said valve member to move it between said blocking position and said release position for gas flow control purposes substantially coincident with movement of said actuating member between its open and its closed positions.

15. A dispensing valve unit according to claim 14 including means for operatively receiving the outlets of said beverage- and said gas-containers, respectively.

16. A dispensing valve unit according to claim 15 in which said valve unit operating member is rotatable in opposite directions between a rest position and said first and second parts of movement.

* * * * *